US008667624B2

(12) United States Patent
Lambert

(10) Patent No.: US 8,667,624 B2
(45) Date of Patent: Mar. 11, 2014

(54) SHOWER DOOR WITH PIVOTED SIDE BY SIDE PANELS

(76) Inventor: Mark E. Lambert, Hanover, MD (US)

( * ) Notice: Subject to any disclaimer, the term of this patent is extended or adjusted under 35 U.S.C. 154(b) by 791 days.

(21) Appl. No.: 12/943,752

(22) Filed: Nov. 10, 2010

(65) Prior Publication Data

US 2011/0197352 A1 Aug. 18, 2011

Related U.S. Application Data

(60) Provisional application No. 61/305,238, filed on Feb. 17, 2010.

(51) Int. Cl.
*A47K 3/00* (2006.01)

(52) U.S. Cl.
USPC ..... 4/607

(58) Field of Classification Search
USPC ..... 4/607, 610, 557
See application file for complete search history.

(56) References Cited

U.S. PATENT DOCUMENTS 3,188,699 A * 6/1965 Walters ..... 49/152
4,981,164 A * 1/1991 Reichel ..... 160/187
5,822,810 A * 10/1998 Chen ..... 4/610

* cited by examiner

*Primary Examiner* — Huyen Le
(74) *Attorney, Agent, or Firm* — Stephen E. Zweig

(57) ABSTRACT

A segmented door for a shower stall, built within a fixed structural frame with a horizontal upper and lower channel. The door is constructed using a plurality (often four or more) of vertically disposed, side by side arranged, moveable panels that are hung from the upper channel by a plurality of moveable and pivoting wheeled hangers engaged with this upper channel. These moveable panels are connected to each other by a plurality of pivotally joined horizontal rods, which enables the moveable panels to move as a group. Often one of the moveable panels is joined to the upper and lower channel by clamp-on hinges, so that this panel is only able to move by pivoting. The moveable panels are able to move between an open door configuration and a closed door configuration, and can be designed with slight overlap so as to prevent shower spray from going beyond the panels.

20 Claims, 3 Drawing Sheets

SHOWER DOOR WITH PIVOTED SIDE BY SIDE PANELS

CROSS REFERENCE TO RELATED APPLICATIONS

This application claims the priority benefit of provisional application 61/305,238, "Rolling Closure with Pivoted, Side-by-Side Panels, for a Shower Stall Doorway", filed Feb. 17, 2010, inventor Mark E. Lambert.

BACKGROUND OF THE INVENTION

1. Field of the Invention

This disclosure relates generally to portal closures and more particularly to a closure for a shower stall.

2. Description of the Related Art

Shower stall closures are generally doors of the conventional kind, that is, having hinges on one side of the door and a latch on the opposing side. The latch is often a magnetic latch, or a spring loaded conventional door latch. The prior art teaches such shower doors in: Lehman U.S. Pat. No. 1,944,440, Backman U.S. Pat. No. 2,627,327, Whitney U.S. Pat. No. 4,598,433, Doan U.S. Pat. No. 244,535, Lax U.S. Pat. No. 3,803,764, Lyons U.S. Pat. No. 5,123,129, Kiefer US2005/0166366, and especially Risk et al U.S. Pat. No. 3,335,784. Such shower doors have certain disadvantages. First of all, shower doors of the conventional type must be made of a structural type of glass that is resistant to being broken and such glass is relatively heavy. Therefore, the framing of a shower stall must be robust in order to support such a heavy door and the framing must be secured to wall panels in an equally robust manner. Such construction is heavy itself, relatively expensive, and generally more time consuming to install. Another disadvantage of such heavy shower doors is that they are difficult to operate, especially by children, older folks and the infirm and senile. An obvious disadvantage of using large glass doors is that they present a significant danger upon being broken.

BRIEF SUMMARY OF THE INVENTION

The presently described invention provides a welcome solution to conventional construction providing light-weight shower door closures that are easy to operate, inexpensive to manufacture and install, durable, and, of course, prevent water from spraying out of the shower room or stall.

In one embodiment, the invention may be a rolling closure type shower door intended to be mounted in a shower stall doorway. The door may comprise multiple (often four or more) pivoted, side-by-side panels. The panels fit underneath a top a structural channel held rigidly in position by a frame with an opening of the channel facing upwardly. The door consists of a plurality of these vertical panels arranged in side-by-side positions, where each of the panels pivotally engaged by a hanger and the hangers engaged with the upper channel, thus holding the panels in an upright attitude. Further, there are a plurality of rods engaged with the hangers and with the panels so that the panels are able to mutually pivot between an open and a closed position. Thus the panels are able to either close-off the shower stall doorway in a closed position, and are alternately able to open the doorway as a pass through in an open position.

Alternatively or additionally, the invention may be a segmented door for a shower stall, built within a fixed structural frame with a horizontal upper and lower channel. The door is constructed using a plurality (often four or more) of vertically disposed, side by side arranged, moveable panels that are hung from the upper channel by a plurality of moveable and pivoting wheeled hangers engaged with this upper channel. These moveable panels are connected to each other by a plurality of pivotally joined horizontal rods, which enables the moveable panels to move as a group. Often one of the moveable panels is joined to the upper and lower channel by clamp-on hinges, so that this panel is only able to move by pivoting. The moveable panels are able to move between an open door configuration and a closed door configuration, and can be designed with slight overlap so as to prevent shower spray from going beyond the panels.

DETAILED DESCRIPTION OF THE INVENTION

The above described drawing figures illustrate the apparatus and its method of use in at least one of its preferred, best mode embodiments, which is further defined in detail in the following description. It should be understood that what is illustrated is set forth only for the purposes of example and should not be taken as a limitation in the scope of the present device or apparatus and its method of use.

Figure 1:
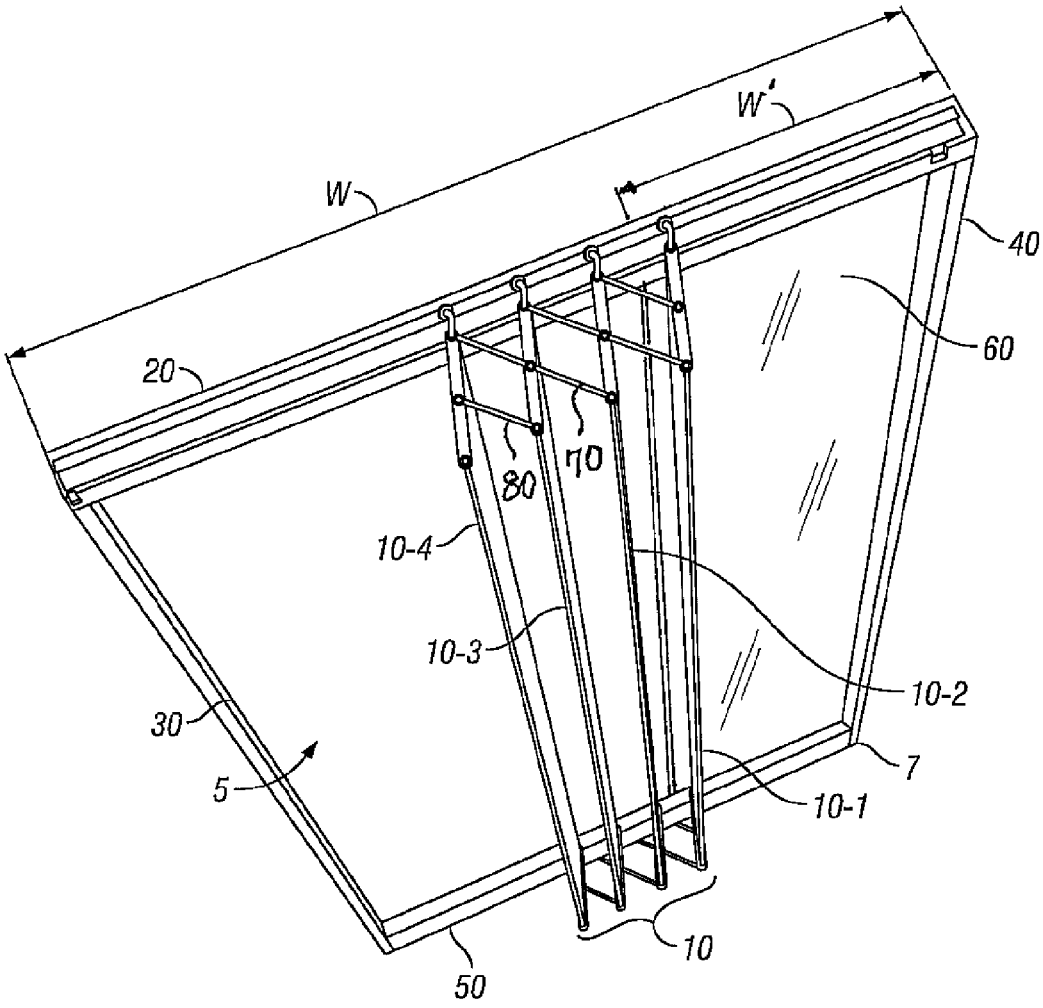
FIG. 1 is a perspective view of a first embodiment of the present invention as seen from above, and from inside a shower stall with individual panels of the invention being shown in their partially open attitude providing access to the shower stall, and showing means for moving all four panels shown laterally.

The present invention, a segmented closure for a shower stall entranceway 5, is described now, in detail. As shown in FIG. 1, the present invention is an entranceway closure which is mounted, and operated, within a fixed structural frame 7. The moving portion of the invention is made-up of a plurality of individual, vertically disposed panels 10 disposed in a side-by-side arrangement. The panels 10 are hung from a horizontally disposed upper channel 20 which is held by, and extends between spaced-apart, vertically disposed, left 30 and right 40 struts. Struts 30 and 40 are appropriately secured to fixed building structures such as walls (not shown). A horizontally disposed lower channel 50 is secured between struts 30 and 40 as well, and is, importantly, oriented in parallel with upper channel 20. Lower channel 50 is preferably supported by a structural base surface (not shown). The struts 30 and 40 define the width W of the structural frame 7, said frame comprising elements 20, 30, 40, and 50. Clearly, as shown in FIG. 1, a fixed panel 60 may be mounted within structural frame 7, thereby taking up a portion W' of its total width W, and leaving entranceway 5 as an open passway to be selectively covered and uncovered by the segmented closure, which, as previously described, is the moving portion of the present invention.

Figure 2:
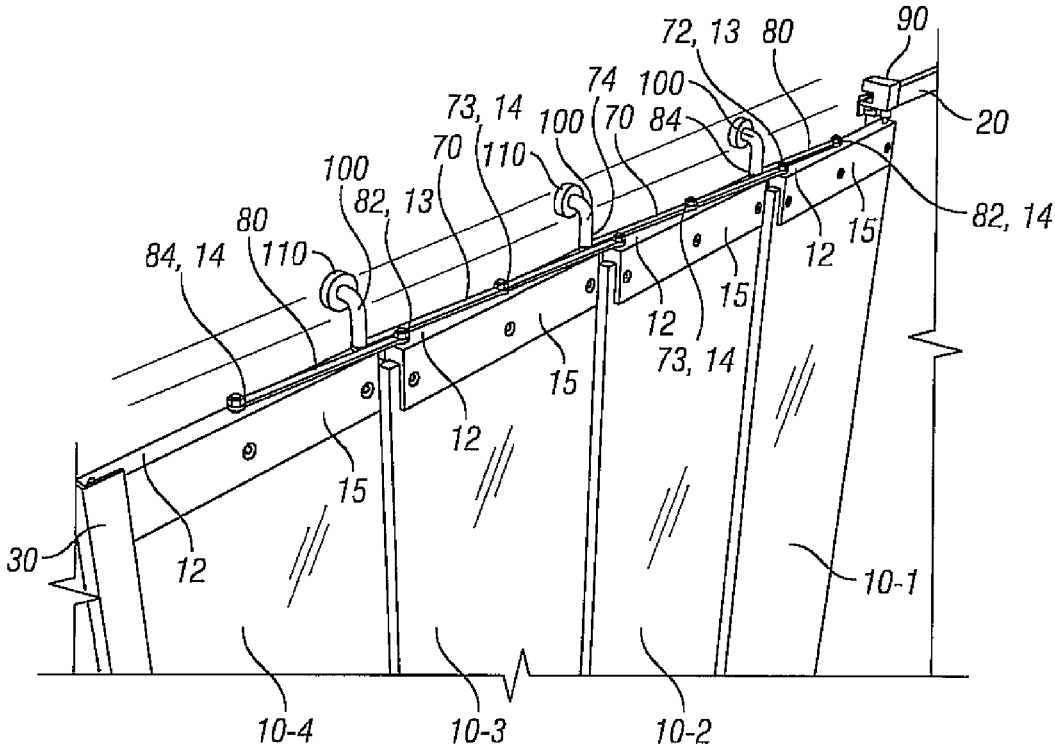
FIG. 2 is an enlarged view of the upper portion of FIG. 1 but showing the right most panel clamped in place, and showing the individual panels in their closed attitude and particularly showing details of hinging and hanging means thereof.

As shown in FIG. 1, the panels 10 are individually referred to as "10-1" for the first panel (adjacent to fixed panel 60), "10-2" for the next panel to its left, and so on. Four panels 10 are shown in the figures, but the number of panels 10 may be any number depending on the width of the doorway opening that is to be covered, and, of course, on the width of the individual panels 10 and the dimension of their overlap as best illustrated in FIG. 2. It is noted that in FIG. 1, all four panels 10 are mounted by wheels 110 so that they are able, as a group, to be moved to the left or right on channel 20. Notice too, that the four panels 10 might be moved behind panel 60 to fully unobstruct entranceway 5. As shown in FIG. 2, panels 10 are arranged in mutually parallel side-by side positions with a slight overlap, and are interconnected by elongated rods; a longer rod 70 and a shorter rod 80 as will be presently described. Noting again that the illustration of FIG. 2 is as viewed from inside the shower stall, we see that each panel 10 overlaps the immediately adjacent panel 10 to its left. In this arrangement, shower spray would preferably originate from the right side of FIG. 2 so that spray would not pass through the closure even if it were not absolutely fully tightly closed. Should the spray originate from the left side of FIG. 2, the panels 10 could be assembled so that each panel 10 would overlap a panel 10 to its right. All of the hardware of this invention is adapted to enable the moving portion (the closure) to open to the right, as in the present illustrations, or to open to the left, that is, it is fully reversible.

Now referring again to FIG. 2, we can understand that in this embodiment, panel 10-1 is joined by clamp-on hinges 90 to both the upper channel 20 (shown) and the lower channel 30 (so that panel 10-1 is laterally immobile, yet is able to pivot between the closed position, as shown in FIG. 2, and the open position, as shown in FIG. 1. Clamp on hinges 90 may be positioned selectively so that the panel 10-1 may be positioned at a desired location on channel 20. A rod 80 (the shorter rod) is pivotally joined at its distal end 82 to the edge 12 of panel 10-1 at a medial position 14 of the edge 12. This same rod 80 is pivotally joined at its proximal end 84 to a vertical hanger 100 and to the distal end of panel 10-2 as more clearly shown in FIG. 1. The means (hardware) for enabling pivotal motion between the parts of this invention, as herein called-for, may be of any type that is known to those of skill in the art, so that these means are not specifically described herein.

Still referring to FIG. 2, rod 70 (the longer rod) is pivotally joined at its distal end 72 to the edge 12 of panel 10-1 at a proximal position 13 on the edge 12. This same rod 70 is also pivotally joined at its medial point 73 to the edge 12 of panel 10-2 at its medial position 14 on the edge 12. Finally, this same rod 70 is also pivotally joined at its proximal end 74 to a vertical hanger 100 and to a distal end of panel 10-3. It is noted that rods 70 in this invention are pivotally joined at three points, a distal point 72, a medial point 73 and a proximal point 74. It is here noted that, as shown in the figures, points to the right of elements shown in the figures are referred to as "distal" and points to the left of elements shown in the figures are referred to as "proximal," with points located between these two are referred to as "medial." A further rod 70 has a relationship with panels 10-2, 10-3 and 10-4 that is identical to the relationship previously described for above described rod 70 with panels 10-1, 10-2, and 10-3. Finally, a further rod 80 is pivotally joined at its distal end 82 to the edge 12 of panel 10-3 at the proximal position 13 on the edge 12, and is also pivotally joined at its proximal end 84 to panel 10-4 at its medial position 14.

In summary, then, we see that the first panel 10 (leftmost or rightmost) in this second embodiment, is always hinged to the channels 20, 50 using clamp-on hinges 90 and is hung from channel 20 in the manner described above for panel 10-1 using a hanger 100. Also, we see that the last panel 10 (rightmost or leftmost) is always mounted as described above for panel 10-4 using a short rod 80 and a hanger 100. Finally, we see that each of the remaining intermediate panels 10 that are mounted between the first panel 10 and the last panel 10 are mounted as described above for panels 10-2 and 10-3 using rods 70 and hangers 100. As shown in the figures, the top of each of the panels 10 are sandwiched within channel stock edgings 15. Assuming that the panels 10 are made of glass, as is preferable, such edgings 15 are necessary for pivotally mounting rods 70 and 80 and hangers 100. However, when the panels 10 are made of a material, such as plastic, wood or metal, where such materials are better able to receive pivotal hardware structural engagements, the edgings 15 may not be necessary. In either case, when we refer above to the distal, medial and proximal ends of the "edge 12," we are referring to either the bare upper or lower edge surfaces of the panel 10 itself, or alternately, to the up-facing (FIG. 2), or down-facing (FIG. 4) edge surface of the edgings 15.

Figure 3:
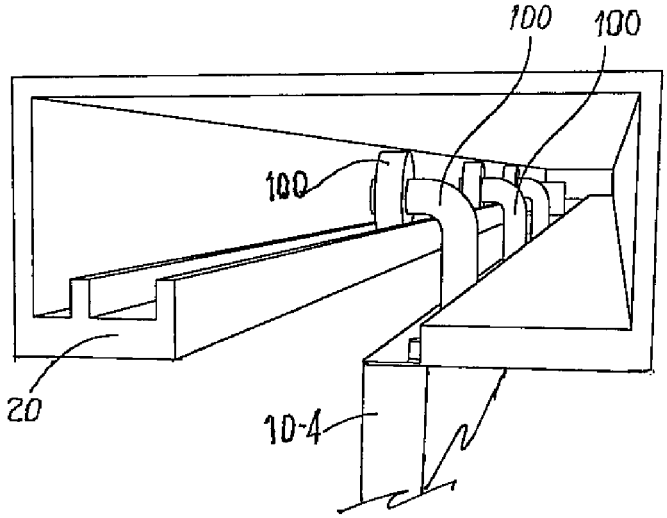
FIG. 3 is a top partial perspective view of the invention particularly illustrating a channel used as a track for receiving the hanging means and in controlling rolling movement of the panels during pivotal action between the closed and open attitudes.

FIG. 3 shows upper channel 20 and its relationship with hangers 100. Hangers 100 are L-shaped bars with wheels 110 mounted at their upper distal ends for rotating about the wheels 110 horizontal rotational axes. The wheels 110 are received by channel 20 and roll therein to afford the pivotal motion of the panels 10 as they fold between the closed and open attitudes, and when in the open attitude, panels 10 are able to be rolled into close adjacency with each other so as to take up relatively little space in the passageway 5 or to one side of it.

Figure 4:
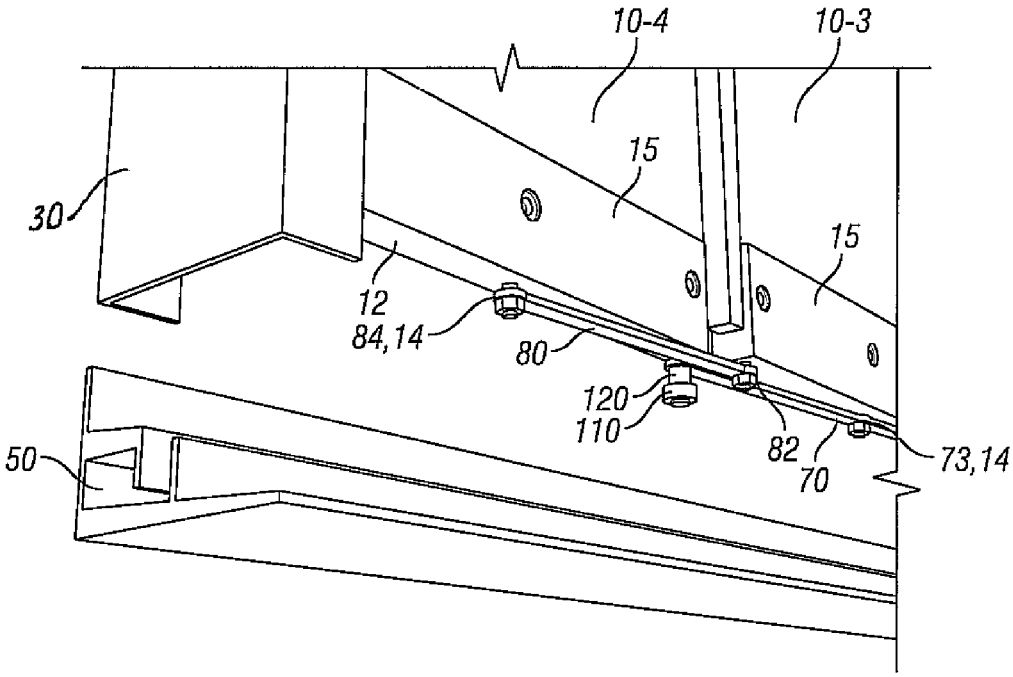
FIG. 4 is an exploded partial perspective view of a lower portion of the invention as seen from below, and particularly illustrating a lower channel and rolling, pivoting and guiding means of the invention as it is normally engaged with the lower channel.
Figure 5:
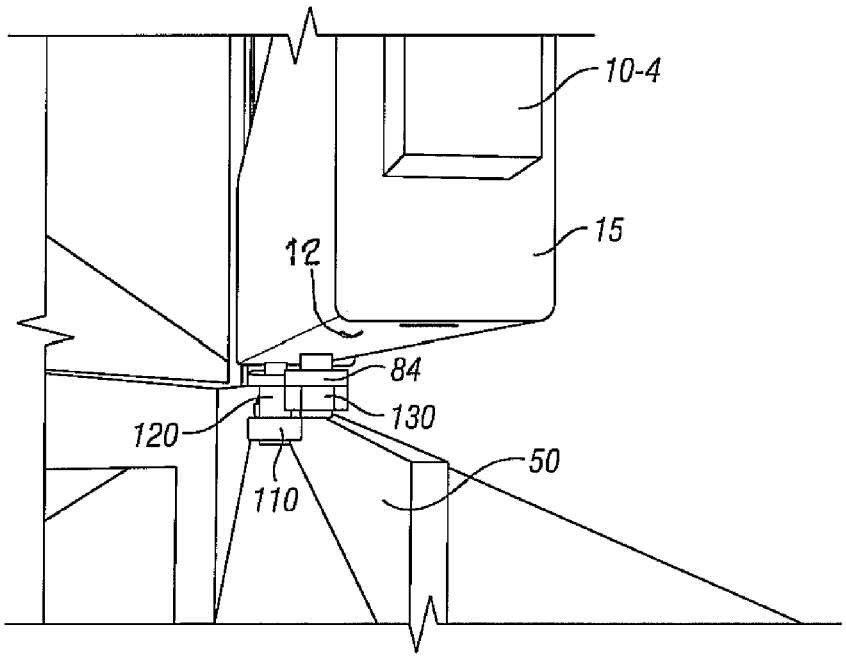
FIG. 5 is a partial perspective view of the lower portion of the invention as seen from one side and particularly illustrating the rolling means engaged with the lower channel.

As shown in FIG. 4, the lower ends of panels 10 are joined by rods 70 and 80 in an identical arrangement as described above for the upper ends of panels 10. However, as shown, instead of joining the rods 70 and 80 to hangers 100, spacers 120 are substituted and wheels 110 are rotationally mounted to the lower terminal ends of spacers 120. As shown in FIG. 5, the spacers 120 and their attached wheels 110 are positioned within channel 50 in order to control the bottom of the panels 10 so that they move in a straight lateral direction. Common hardware, such as nuts and threaded studs 130 are used to fasten channels 15 to panels 10 and to mount the rods 70 and 80 to the channels 15. Other hardware is used to fasten the other parts of this invention together as would be within the normal skill of an individual versed in the art.

In some embodiments, in order to create a still firmer seal between adjacent panels when in the shut position, it may be advantageous to cover the vertical edges of the panels (often from top to bottom or at least a substantial amount, i.e. greater than 75%, of the length from top to bottom) with strips of a deformable material such as rubber or plastic (such as polyvinyl). This helps close any remaining openings between the panels, thus reducing the amount of water spray from the shower heads that can penetrate past the shower doorway.

The enablements described in detail above are considered novel over the prior art of record and are considered critical to the operation of at least one aspect of the apparatus and its method of use and to the achievement of the above described uses. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for anyone of the elements described and its various embodiments or that a single element may be substituted for two or more elements in a claim.

Changes from the described subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The invention claimed is:

1. A segmented door for a shower stall, said door comprising:

a fixed structural frame with a horizontally disposed upper channel, and a horizontally disposed lower channel disposed parallel to said upper channel;

a plurality of vertically disposed moveable panels hung from said upper channel by a plurality of moveable and pivoting hangers engaged with said upper channel;

said moveable panels being disposed in a side by side arrangement between said upper channel and said lower channel;

said moveable panels being connected to each other by a plurality of pivotally joined horizontal rods, enabling said moveable panels to move as a group; and wherein said moveable panels are able to move between an open door configuration and a closed door configuration.

2. The door of claim 1, wherein said upper channel is affixed to a building structure by way of spaced apart vertically disposed struts.

3. The door of claim 1, wherein said lower channel is supported by a structural base surface.

4. The door of claim 1, wherein said plurality of vertically disposed moveable panels comprises at least four vertically disposed moveable panels.

5. The door of claim 1, wherein said pivoting hangers further comprise wheels capable of moving within the confines of an opening in said upper channel.

6. The door of claim 1, wherein said moveable panels are disposed with overlap between panels, so that shower spray originating from at least one location inside said shower stall will not pass through the plurality of panels when said panels are disposed in a closed door configuration.

7. The door of claim 1, wherein one moveable panel is joined to said upper channel and said lower channel by clamp-on hinges so that said one moveable panel is only able to move by pivoting.

8. The door of claim 1, wherein said pivotally joined horizontal rods comprise longer rods pivotally joined to said three of said moveable panels at three points, and shorter rods pivotally joined to said two of said moveable panels at two points.

9. The door of claim 1, wherein said moveable panels are glass panels.

10. The door of claim 9, wherein said moveable panels are sandwiched between channel stock edgings.

11. The door of claim 1, wherein said moveable panels are plastic, wood, or metal.

12. The door of claim 1, wherein said hangers are L shaped bars with wheels.

13. A segmented door for a shower stall, said door comprising:

a fixed structural frame with a horizontally disposed upper channel, and a horizontally disposed lower channel disposed parallel to said upper channel;

at least four vertically disposed moveable panels hung from said upper channel by a plurality of moveable and pivoting hangers with wheels engaged with said upper channel;

said moveable panels being disposed in a side by side arrangement between said upper channel and said lower channel;

said moveable panels being connected to each other by a plurality of pivotally joined horizontal rods, enabling said moveable panels to move as a group;

wherein said pivotally joined horizontal rods comprise longer rods pivotally joined to said three of said moveable panels at three points, and shorter rods pivotally joined to said two of said moveable panels at two points;

wherein one moveable panel is joined to said upper channel and said lower channel by clamp-on hinges so that said one moveable panel is only able to move by pivoting; and wherein said moveable panels are able to move between an open door configuration and a closed door configuration.

14. The door of claim 13, wherein said upper channel is affixed to a building structure by way of spaced apart vertically disposed struts, and said lower channel is supported by a structural base surface.

15. The door of claim 13, wherein said moveable panels are disposed with overlap between panels, so that shower spray originating from at least one location inside said shower stall will not pass through said moveable panels when said panels are disposed in a closed door configuration.

16. The door of claim 13, wherein said moveable panels are glass panels sandwiched between channel stock edgings.

17. The door of claim 13, wherein said moveable panels are plastic, wood, or metal.

18. A segmented door for a shower stall, said door comprising:

a fixed structural frame with a horizontally disposed upper channel, and a horizontally disposed lower channel disposed parallel to said upper channel;

at least four vertically disposed moveable panels hung from said upper channel by a plurality of moveable and pivoting hangers with wheels engaged with said upper channel;

said moveable panels being disposed in a side by side arrangement between said upper channel and said lower channel;

said moveable panels being connected to each other by a plurality of pivotally joined horizontal rods, enabling said moveable panels to move as a group;

wherein said pivotally joined horizontal rods comprise longer rods pivotally joined to said three of said moveable panels at three points, and shorter rods pivotally joined to said two of said moveable panels at two points;

wherein one moveable panel is joined to said upper channel and said lower channel by clamp-on hinges so that said one moveable panel is only able to move by pivoting;

wherein said moveable panels are disposed with overlap between panels, so that shower spray originating from at least one location inside said shower stall will not pass through said moveable panels when said panels are disposed in a closed door configuration;

wherein said moveable panels are glass panels sandwiched between channel stock edgings; and wherein said moveable panels are able to move between an open door configuration and a closed door configuration.

19. The door of claim 18, wherein said upper channel is affixed to a building structure by way of spaced apart vertically disposed struts, and said lower channel is supported by a structural base surface.

20. The door of claim 18, wherein at least the vertical edges of said moveable panels are covered substantially from top to bottom with a deformable material in order to facilitate a tighter seal between said moveable panels when said moveable panels are in a closed door configuration.

* * * * *